US006470967B1

(12) United States Patent
Henry

(10) Patent No.: US 6,470,967 B1
(45) Date of Patent: Oct. 29, 2002

(54) SAMPLING DEVICE

(76) Inventor: Mark A. Henry, 123 Dunlop St., Lansing, MI (US) 48910

( * ) Notice: Subject to any disclaimer, the term of this patent is extended or adjusted under 35 U.S.C. 154(b) by 31 days.

(21) Appl. No.: 09/698,350

(22) Filed: Oct. 27, 2000

Related U.S. Application Data

(60) Provisional application No. 60/162,599, filed on Oct. 29, 1999.

(51) Int. Cl.[7] ..... E21B 49/08

(52) U.S. Cl. ..... 166/264; 73/864.74; 73/864.91; 166/169; 166/250.03; 175/59

(58) Field of Search ..... 166/169, 264, 166/250.03; 175/20, 21, 69; 73/864.74, 864.11, 864.12, 864.91

(56) References Cited

U.S. PATENT DOCUMENTS

| | | | | |
|---|---|---|---|---|
| 185,024 | A | | 12/1876 | Gent |
| 323,057 | A | | 7/1885 | Meylor |
| 2,896,444 | A | | 7/1959 | Forman et al. |
| 2,968,184 | A | | 1/1961 | Archer et al. |
| 3,075,588 | A | | 1/1963 | Mitchell |
| 4,310,057 | A | | 1/1982 | Brame |
| 4,804,050 | A | | 2/1989 | Kerfoot |
| 5,000,051 | A | | 3/1991 | Bredemeier |
| 5,150,622 | A | | 9/1992 | Vollweiler |
| 5,209,129 | A | | 5/1993 | Jaselskis et al. |
| 5,327,981 | A | | 7/1994 | Morgan |
| 5,411,103 | A | * | 5/1995 | Werner ..... 175/20 |
| 5,487,431 | A | | 1/1996 | Webb |
| 5,922,975 | A | * | 7/1999 | Butler et al. ..... 73/864.74 |

* cited by examiner

*Primary Examiner*—William Neuder
(74) *Attorney, Agent, or Firm*—Mary M. Moyne; Ian C. McLeod

(57) ABSTRACT

A device (10) for collecting fluid samples from a subsurface (100), injecting fluids into a subsurface and measuring the hydrostatic pressure of groundwater in a subsurface is described. The device includes an outer tube (12) with a center bore (12D) and openings (12E) at one end (12B) and a rigid inner rod (18) configured to be telescopingly inserted into the center bore of the outer tube. The inner rod provides support and prevents damage to the outer tube during insertion into the subsurface. The device is inserted into the subsurface until the openings in the outer tube are adjacent the testing area. The inner rod is then removed from the outer tube. To collect fluid samples, the samples are retrieved from the fluid which has moved from the subsurface through the openings to the center bore of the outer tube. To inject fluid into the subsurface, the fluid is injected into the center bore and flows through the openings to the subsurface. To use the device to measure the hydrostatic elevation of the groundwater in the subsurface relative to the surface water body, a pressure measuring device is connected to the outer tube.

34 Claims, 4 Drawing Sheets

SAMPLING DEVICE

CROSS-REFERENCE TO RELATED APPLICATIONS

This application claims the benefit of U.S. Provisional Application Serial No. 60/162,599, filed Oct. 29, 1999.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION (1) Field of the Invention

The present invention relates to a device which allows for inserting or removing a fluid from a subsurface and which can also be used to determine the hydrostatic pressure of the groundwater in the subsurface relative to the surface water body.

(2) Description of the Related Art

The transitional zone at the groundwater/surface water interface is usually rich in biomass and may play a predominant role in the bioattenuation of contaminated groundwater entering surface water bodies. Usually these biologic processes have limited effectiveness in attenuating highly contaminated groundwater, leaving a plume of parent contamination and metabolic byproducts that eventually expresses itself in receiving waters —usually classified as non-point sources of pollution because of the uncertainty of the discharge area. Part of the problem in the detection and study of these plumes is that in the past, there were no devices available for the rapid, discrete collection of pore water samples. Reliance on conventional technology and techniques to perform a detailed investigation required extensive effort and burdensome equipment.

It is of great interest to scientists, engineers, and environmental regulators, to know the location at which groundwater contamination enters and interfaces with surface water bodies, and the geochemical nature of that venting groundwater. Typically, investigators utilize machine driven piezometers or monitoring well point emplacements to measure groundwater elevations and collect soil gas or groundwater samples. The difficulty that the installation of these driven monitoring wells poses and the large amount of time required for their sampling usually limits their utility, number, and effectiveness at a particular site. In addition, the current practice uses devices that are prone to damage from screen abrasion or clogging with fine sediments, are difficult to decontaminate, and generate large volumes of waste water to effectively purge the system and deliver samples that are representative of the pore fluids. Well drilling equipment or direct-push technologies are typically employed for the installation of these monitoring well points. Many areas that are inaccessible to this powered equipment are easily sampled by investigators using the present invention.

The present invention allows for collecting pore water samples from beneath surface water bodies or the beach areas surrounding them. The work conducted at several contamination sites indicates that many groundwater plumes discharge in surface water bodies in 2 to 3 foot (61 to 91 cm) of water depth. Many plumes, especially light, non-aqueous phase liquid (LNAPL) plumes can be delineated by collection of samples in very shallow water or from under beaches. If groundwater samples are collected in a transect perpendicular to groundwater flow in the suspected area of plume discharge to an open water body, their analysis yields information about the aerial extent of contaminant discharge to the water body. At this point, additional sampling can complement the initial data and provide the information necessary to map the plume expression in both magnitude and aerial distribution. This is becoming increasingly important to regulators as they decide the ecological impacts of discharging contaminant plumes.

The related art has shown various subsurface sampling devices which have openings which can be opened or closed. In particular, U.S. Pat. No. 5,209,129 to Jaselskis et al describes a subsurface sampler having an outer tube with an opening and an inner tube or sleeve mounted within the outer tube. The inner tube is rotated to open or close the opening in the outer tube.

Also of interest are U.S. Pat. No. 4,310,057 to Brame; U.S. Pat. No. 4,804,050 to Kerfoot; U.S. Pat. No. 5,150,622 to Vollweiler; U.S. Pat. No. 5,327,981 to Morgan; and U.S. Pat. No. 5,487,431 to Webb which show devices for sampling underground fluids. The devices have inner and outer tubes. The outer tube covers the openings in the inner tube. The tubes are moved in relation to each other to expose the openings in the inner tubes. In the Vollweiler and Kerfoot patents, the outer tube is completely removed.

Only of minimal interest are U.S. Pat. No. 185,024 to Gent; U.S. Pat. No. 323,057 to Meylor; U.S. Pat. No. 2,896,444 to Forman et al; and U.S. Pat. No. 2,968,184 to Archer et al which show grain samplers. The samplers have an outer tube with openings and an inner member or tube which is movable to open and close the openings. The inner member is either rotated or moved up and down to open and close the openings. The inner member is not removable from the outer tube.

Of some interest is U.S. Pat. No. 3,075,588 to Mitchell which shows a sampler having a tube which is inserted into the soil to a specific depth. A plug in the end of the tube is then removed and the tube is driven further into the soil to the desired depth to collect the sample.

Also of some interest is U.S. Pat. No. 5,000,051 to Bredemeier which describes a lysimeter probe having an outside porous tube and an inner connecting rod having openings to allow solution which passes from the soil through the porous tube to enter the interior space of the connecting rod. The connecting rod connects the upper and lower parts of the body of the probe to relieve pressure from the porous tube. The connecting rod is not removed and does not prevent solution from entering the porous tube.

There remains the need for a device which allows for collecting fluid samples from a subsurface or injecting fluid into a subsurface where an inner rod is used to cover the opening of the outer tube and to provide structural support during insertion into the subsurface and which is removed to allow for use of the device to collect or insert fluids in the subsurface. In addition, none of the devices show a device which can be used to collect or inject fluid samples into the subsurface and which also can be used to determine the hydrostatic head of the groundwater in the subsurface relative to the surface water body.

SUMMARY OF THE INVENTION

This invention relates directly to geohydrological and geochemical studies, as well as contamination site investigation. The use of this device facilitates the rapid collection of discrete subsurface fluids (liquid or gas) for either on-site or laboratory analysis. The data from these samples yields information that may be used to determine the fate and transport of contaminants in groundwater or soil gas and delineate those impacted areas both vertically and horizontally. Samples may be collected on the land surface or from sediments beneath a surface water body where the investigator and the device are partially or completely immersed in the water body. The device provides the means to rapidly extract fluid samples from the pore spaces in soils or sediments using a syringe or suction-lift pump. The device includes an outer tube with a center bore and openings at one end and a rigid inner rod configured to be telescopingly inserted into the center bore of the outer tube. The outer tube has a handle at one end to facilitate insertion of the device into the subsurface. The inner rod also has a handle at one end to facilitate insertion of the inner rod into the center bore of the outer tube. The handles also allow the inner rod to be held in place during insertion of the device into the subsurface. The inner rod provides support and prevents damage to the outer tube during the rigors of insertion into the subsurface. To use the device to collect fluid samples, the device is inserted into the subsurface until the openings in the outer tube are adjacent the area from which the sample is to be removed. The inner rod is then removed from the outer tube and the sample is retrieved from the fluid which has moved from the subsurface through the openings to the center bore of the outer tube.

The device can also serve effectively as a fluid delivery device. Once the device has been inserted into the subsurface and the inner rod has been removed, a pump or syringe can introduce fluids such as tracer mixtures, chemical amendments, or even microorganisms into the center bore and through the openings into the subsurface with very little disturbance to the natural lithology.

The device can also be used to measure the hydrostatic elevation of the groundwater in the subsurface relative to the surface water body. Once the device has been properly deployed in the subsurface and purged free of sediment, a pressure measuring device such as a manometer may be connected to the top end of the outer tube. The direction of groundwater flow relative to the surface water body at that particular location, i.e. whether the surface water body is at a greater or lesser hydrostatic pressure than groundwater beneath it, can then be determined.

The device is not easily subject to clogging and can be easily cleaned and decontaminated in the field using readily available equipment, allowing the device to be reused indefinitely. The simplicity and dependability of the device together with its ease of use overcome the limitations and disadvantages of prior groundwater sampling systems and form the basis of the primary objective of the invention. This device is extremely useful for site characterization, research, or remediation purposes.

The present invention relates to a device for use in moving a fluid into or out of a subsurface which comprises: an outer tube having an open first end and a closed second end with a center bore extending therebetween defining a longitudinal axis of the device and having at least one opening adjacent the second end; and an inner rod having a first end and a second end with a handle mounted adjacent the first end and configured to be telescopingly inserted into the center bore of the outer tube, wherein in use, the inner rod is inserted into the center bore of the outer tube such that the inner rod closes the opening at the second end of the outer tube and the device is inserted into the subsurface with the second end of the outer tube entering the subsurface first, wherein when the device is at a desired depth in the subsurface, the inner rod is completely removed from the outer tube which opens the opening which allows fluid to be inserted or removed from the subsurface through the opening.

Further, the present invention relates to a method for delivering a fluid to a subsurface which comprises the steps of: providing a device having an outer tube with opposed ends with a center bore extending between the ends and with at least one opening adjacent the second end extending into the center bore and having an inner rod with opposed ends with a handle at one end and configured to be telescopingly inserted into the center bore of the outer tube; inserting the inner rod into the center bore of the outer tube such that the inner rod closes the opening; inserting the device into the subsurface to a desired depth; removing the inner rod from the outer tube such that the opening is opened; providing a means for inserting the fluid into the center bore of the device; and inserting the fluid into the center bore of the device such that the fluid exits the device through the opening and enters the subsurface adjacent the opening.

Still further, the present invention relates to a sampling device for use in collecting a fluid sample from a subsurface, which comprises: an outer tube having an open first end and a closed second end with a center bore extending therebetween defining a longitudinal axis of the device and having at least one opening adjacent the second end; and an inner rod having a first end and a second end with a handle mounted adjacent the first end and configured to be telescopingly inserted into the center bore of the outer tube wherein to collect the fluid sample from the subsurface, the inner rod is inserted into the center bore of the outer tube such that the inner rod closes the opening at the second end of the outer tube and the device is inserted into the subsurface with the second end of the outer tube entering the subsurface first, wherein when the device is at a desired depth in the subsurface, the inner rod is removed from the outer tube which opens the opening and allows fluid to move into the center bore of the outer tube and the fluid sample is collected from the center bore through the open first end of the outer tube.

Further still, the present invention relates to method for removing a fluid sample from a subsurface which comprises the steps of: providing a sampling device having an outer tube with opposed ends with a center bore extending between the ends and with at least one opening adjacent the second end extending into the center bore and having an inner rod with opposed ends with a handle at one end and configured to be telescopingly inserted into the center bore of the outer tube; inserting the inner rod into the center bore of the outer tube such that the inner rod closes the opening; inserting the sampling device into the subsurface to a desired depth; removing the inner rod from the outer tube such that the opening is opened and fluid in the subsurface adjacent the opening is able to move into the center bore of the outer tube; providing a means for removing the fluid sample from the fluid in the center bore of the outer tube; and removing the fluid sample from the fluid in the center bore of the outer tube.

Still further, the present invention relates to a device for measuring hydrostatic pressure of groundwater in a subsurface under a surface water body, which comprises: an outer tube having an open first end and a closed second end with a center bore extending therebetween defining a longitudinal axis of the device and having at least one opening adjacent the second end; an inner rod having a first end and a second end with a handle mounted adjacent the first end and configured to be telescopingly inserted into the center bore of the outer tube; and a measuring tube having a first end and a second end and configured to be connected at the first end to the first end of the outer tube and having a length such that when the second end of the measuring tube is spaced apart from the surface water body in a direction opposite the second end of the outer tube, a portion of the measuring tube between the ends is positioned in the surface water body, wherein to determine the hydrostatic pressure of the groundwater in the subsurface, the inner rod is inserted into the center bore of the outer tube such that the inner rod closes the opening at the second end of the outer tube and the device is inserted into the subsurface with the second end of the outer tube entering the subsurface first, wherein when the device is at a desired depth in the subsurface, the inner rod from the outer tube is removed which opens the opening and allows fluid to move into the center bore of the outer tube and the measuring tube is connected to the first end of the outer tube and positioned such that the second end of the measuring tube is spaced apart from the surface water body in a direction opposite the second end of the outer tube and the portion of the tube between the ends is positioned in the surface water body wherein the hydrostatic pressure is determined by a water level in the measuring tube.

Finally, the present invention relates to a method for measuring hydrostatic pressure of groundwater in a subsurface under a surface water body, which comprises the steps of: providing a device having an outer tube with opposed ends with a center bore extending between the ends and with at least one opening adjacent the second end extending into the center bore and having an inner rod with opposed ends with a handle at one end and configured to be telescopingly inserted into the center bore of the outer tube and a measuring tube having a first end and second end and configured to be connected at the first end to one end of the outer tube; inserting the inner rod into the center bore of the outer tube such that the inner rod closes the opening adjacent the second end of the tube; inserting the device into the subsurface to a desired depth; removing the inner rod from the outer tube of the device such that the opening is opened; connecting the first end of the measuring tube to the end of the outer tube; positioning the measuring tube such that the second end of the tube is spaced apart from the surface water body and a portion of the measuring tube between the ends is positioned in the surface water body; providing a means for drawing the groundwater from the subsurface in the center bore of the outer tube into the measuring tube; connecting the means for drawing the groundwater to the second end of the measuring tube and drawing groundwater from the center bore to the second end of the measuring tube; disconnecting the means for drawing the groundwater from the second end of the measuring tube; and measuring a water level in the measuring tube to determine the hydrostatic pressure of the groundwater in the subsurface relative to the surface water body.

The substance and advantages of the present invention will become increasingly apparent by reference to the following drawings and the description.

DESCRIPTION OF THE PREFERRED EMBODIMENTS

Figure 1:
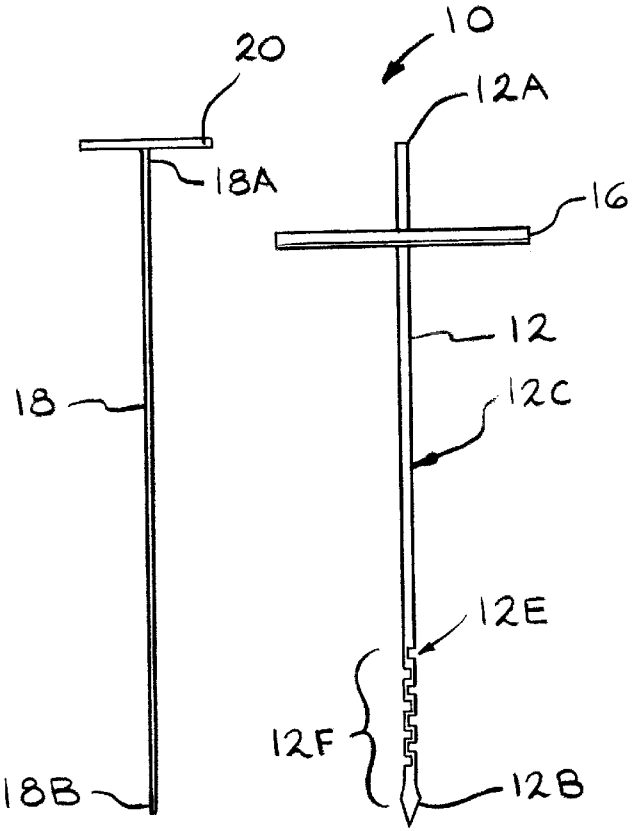
FIG. 1 is a front view of the device 10 with the inner rod 18 removed from the outer tube 12.
Figure 3:
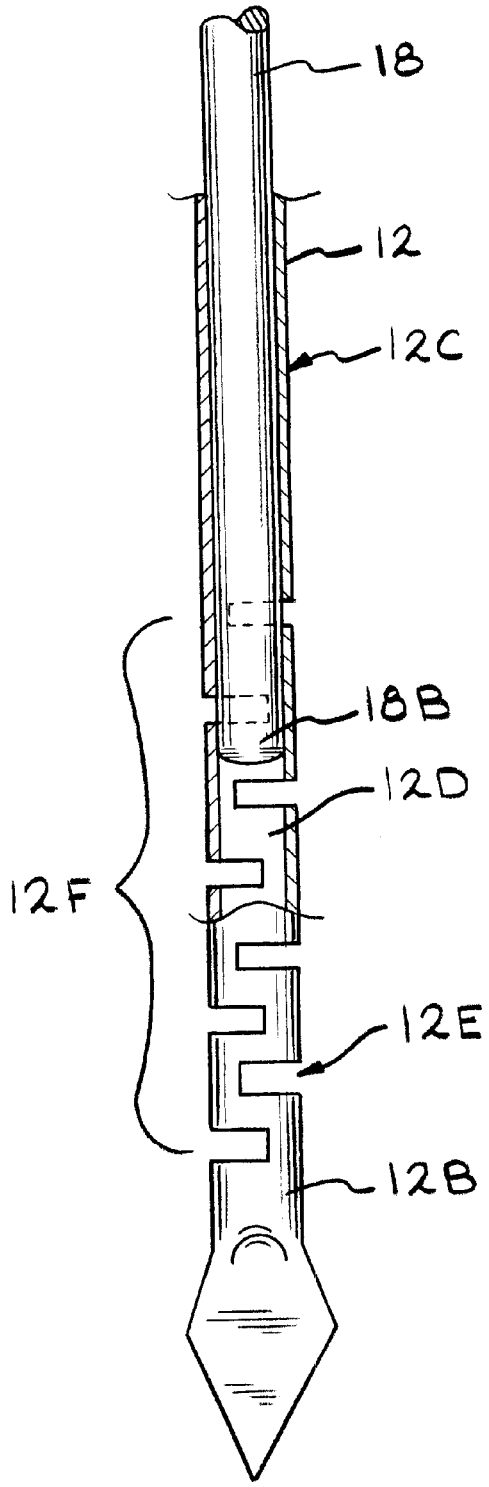
FIG. 3 is a partial front view of the bottom end 12B of the outer tube 12 showing the screened zone 12F and the inner rod 18 partially inserted into the outer tube 12.
Figure 5:
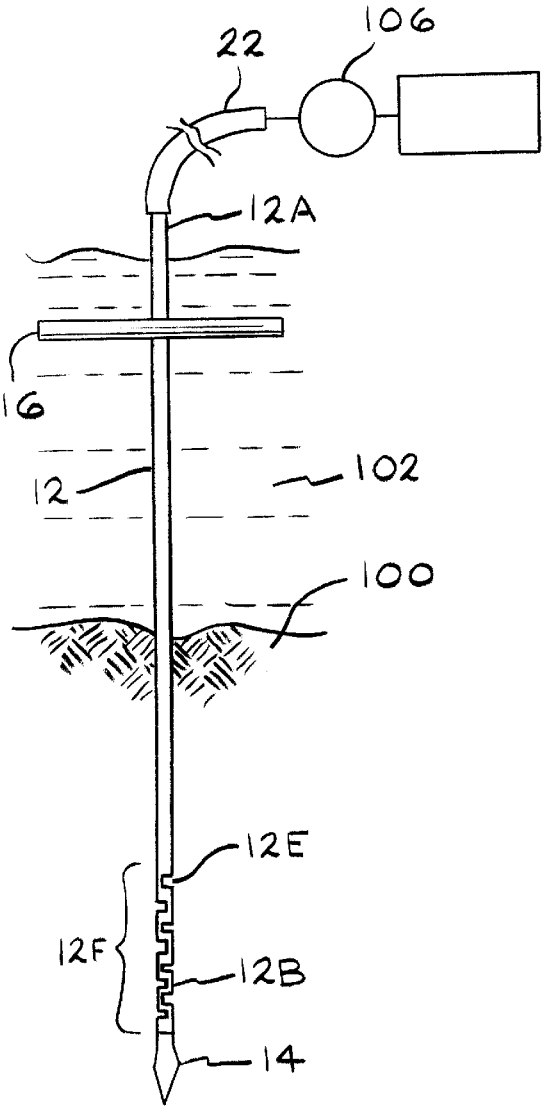
FIG. 5 is a front view of the device 10 in use in a subsurface 100 below a surface water body 102 showing a pump 106 used to collect or remove the fluid.

FIG. 1 shows the device 10 of the present invention. The device 10 includes an outer tube 12 and an inner rod 18. The outer tube 12 has an open top end 12A and a closed bottom end 12B with a sidewall 12C extending therebetween. A center bore 12D extends between the ends 12A and 12B and defines a longitudinal axis A—A of the device 10. In the preferred embodiment, the outer tube 12 and the center bore 12D have a cylindrical shape along the longitudinal axis A—A of the device 10. The sidewall 12C has openings 12E which form a screened zone 12F adjacent the bottom end 12B of the outer tube 12 (FIG. 3). The screened zone 12F preferably extends from the bottom of the lowermost opening 12E to the top of the uppermost opening 12E. In the preferred embodiment, the openings 12E are slots which extend perpendicular to the longitudinal axis A—A of the device 10. However, it is understood that any type or shape of opening can be used. Preferably, the slots 12E are positioned on two (2) opposing sides of the outer tube 12 in such a matter that the slots 12E originating on one (1) side of the outer tube 12 lie between the slots 12E originating on the opposing side. This process removes approximately ¾ of the sidewall 12C in each slot 12E. Thus, the slots 12E extend around ¾ of the circumference of the outer tube 12. In the preferred embodiment, the openings 12E remove approximately twenty percent (20%) of the sidewall 12C of the outer tube 12 in the screened zone 12F. The center bore 12D is of a length as to extend from the open top end 12A to slightly below the screened zone 12F of the outer tube 12. However, the center bore 12D may stop at the bottom end of the screened zone 12F. The bottom end 12B of the outer tube 12 is closed and preferably forms a point. Alternatively, the bottom end 12B forms a spade like angle. Where a hollow length of tubing is used to construct the outer tube 12, the bottom end of the tubing can be crimped to close off the tubing and then shaped to a spade like configuration. Preferably, the bottom end 12B of the outer tube 12 is shaped to allow for easy insertion of the device 10 into the subsurface 100 without having to drill a pilot hole. In an alternative embodiment, the bottom end 12B of the outer tube 12 is provided with a removable boring tip 14 (FIG. 5). This allows the boring tip 14 to be replaced when needed without having to replace the entire device 10. A handle 16 is preferably provided adjacent the top end 12A of the outer tube 12. The handle 16 preferably extends outward from opposite sides of the sidewall 12C of the outer tube 12 in a direction perpendicular to the longitudinal axis A—A of the device 10. The handle 16 is positioned such as to allow for leverage when inserting the device 10 into the subsurface 100. The handle 16 also provides leverage for insertion, retention and removal of the inner rod 18 with respect to the outer tube 12. In the preferred embodiment, the handle 16 is welded onto the outer tube 12. However, the handle 16 and outer tube 12 can be constructed as a unitary piece.

The inner rod 18 is configured to be inserted into the center bore 12D of the outer tube 12 and has a crosssectional shape similar to the shape of the center bore 12D of the outer tube 12. The inner rod 18 has a closed top end 18A and a closed bottom end 18B with a handle 20 mounted adjacent the top end 18A. The handle 20 preferably extends outward from either side of the rod 18 perpendicular to the longitudinal axis A—A of the device 10 when the rod 18 is inserted into the outer tube 12. In the preferred embodiment, the handle 20 is mounted on the top end 18A of the inner rod 18. The inner rod 18 is preferably straight and constructed of a rigid, solid material. The outer diameter of the rod 18 is only slightly less than the diameter of the center bore 12D of the outer tube 12 such that the inner rod 18 is a close fit with the center bore 12D of the outer tube 12. In the preferred embodiment, the length of the inner rod 18 between the bottom end 18B and the handle 20 is essentially the length of the center bore 12D of the outer tube 12. Thus, when the handle 20 of the inner rod 18 is in contact with the top end 12A of the outer tube 12, the inner rod 18 extends the complete length of the center bore 12D of the outer tube 12 and completely covers and closes the openings 12E in the screened zone 12F of the outer tube 12. The device 10 is preferably constructed of stainless steel. However, the device 10 can be constructed of any material which is strong and durable and compatible with the subsurface 100 and the fluids to be removed or inserted.

Optionally, a flexible, hollow connection tube 22 is provided for attaching to the top end 12A of the outer tube 12 (FIG. 5). The connection tube 22 is preferably connected to the outer tube 12 by a clamp (not shown). The connection tube 22 allows for easier connection of a suction or delivery means such as a pump 106 or syringe 104 to the top end 12A of the outer tube 12. In one (1) embodiment, for a device 10 having a center bore volume of 1.5 mL, the connection tube 22 is constructed of TYGON with a 0.25 inch (0.635 cm) outer diameter and a 0.125 inch (0.3175 cm) inner diameter for use with a 50 mL syringe 104.

Figure 6:
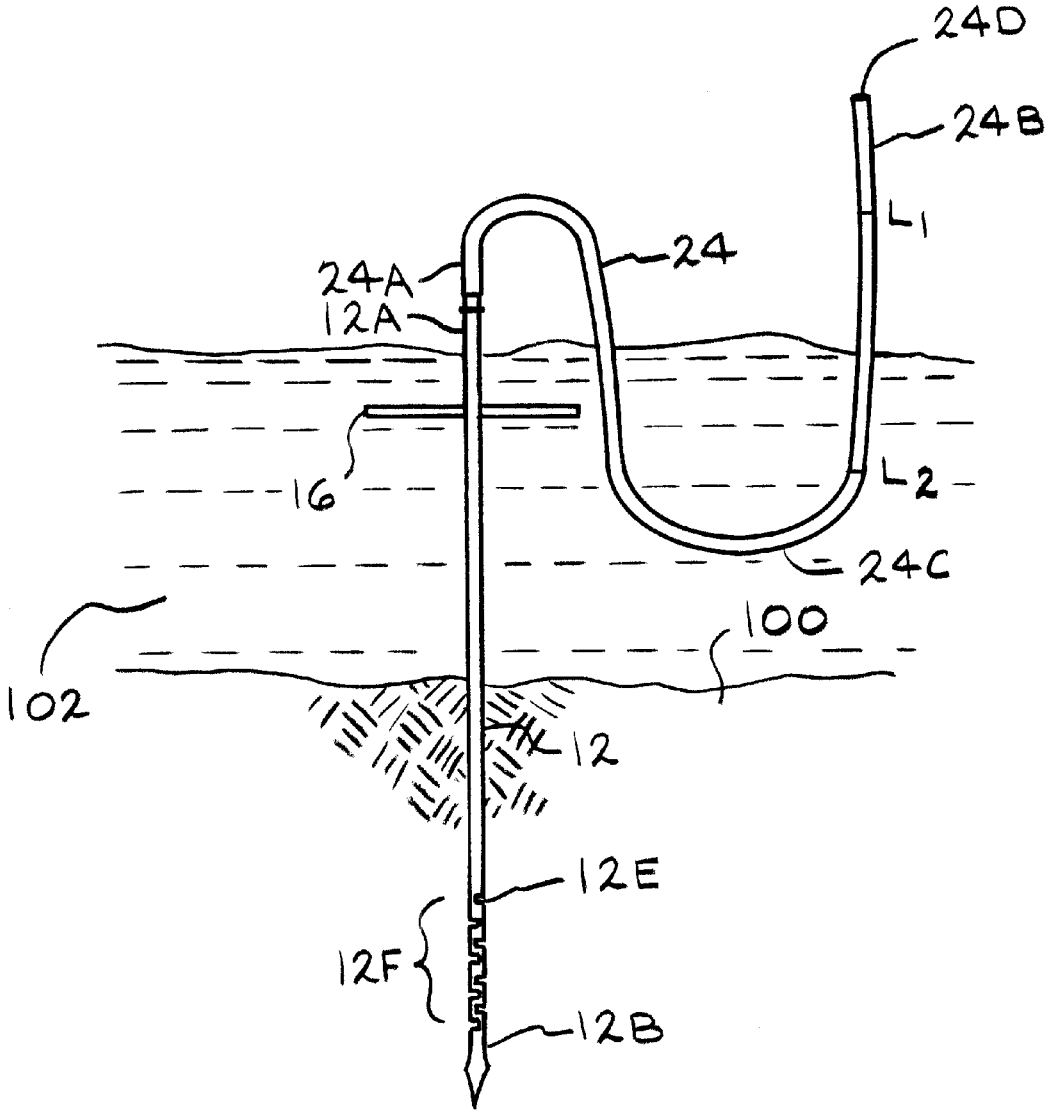
FIG. 6 is a front view of the device 10 in use to measure the hydrostatic pressure of the groundwater in the subsurface 100 relative to the surface water body 102.

When the device 10 is to be used to determine the hydrostatic pressure of the groundwater of the subsurface 100, a measuring tube 24 is also provided (FIG. 6). The measuring tube 24 has an open first end 24A and an open second end 24B with a middle portion 24C located therebetween. The measuring tube 24 has a center bore 24D extending between the ends 24A and 24B. The first end 24A is configured to be connected to the top end 12A of the outer tube 12 after the inner rod 18 has been removed. The measuring tube 24 is preferably connected to the top end 12A of the outer tube 12 by a clamp. The second end 24B of the measuring tube 24 is configured to be connected to a suction means such as a pump 106 or syringe 104. The measuring tube 24 is preferably constructed of a flexible material and is of a length such that a middle portion 24C of the tube 24 can be positioned below the water level of the surface water body 102 and the second end 24B of the measuring tube 24 can be positioned above the water level of the surface water body 102 (FIG. 6). However, it is understood that the measuring tube 24 could be constructed of a rigid material which is permanently positioned with a middle portion 24C below the second end 24B of the measuring tube 24. In the preferred embodiment, the measuring tube 24 is transparent to allow for viewing the level of water along the entire length of the measuring tube 24. However, the tube 24 could be opaque and provided with viewing windows at different sections along the tube 24 which allow for viewing the water level at those sections along the measuring tube 24.

Figure 4:
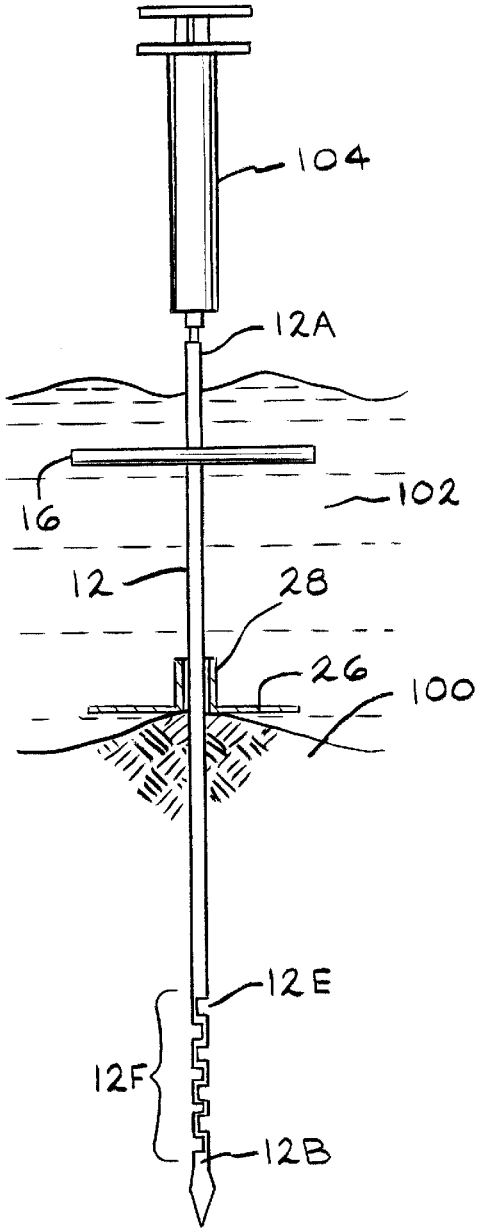
FIG. 4 is a front view of the device 10 in use in a subsurface 100 beneath a surface water body 102 showing a syringe 104 used to collect or remove the fluid.

A support platform 26 can also be provided to prevent lateral movement and slippage of the device 10 as the sampling, fluid insertion, or pressure measuring is conducted near the top of the sampling hole (FIG. 4). The platform 26 has a center opening through which the device 10 is inserted. Alternatively, a support tube 28 is mounted over the opening and extends upward perpendicular to the platform 26. During use, the platform 26 is positioned on the subsurface 100. The device 10 is then inserted through the opening or support tube 28 into the subsurface 100. The support platform 26 offsets the leverage of the device 10 and reduces hole degeneration. The support tube 28 guides the outer tube 12 during inserting into the subsurface 100 and prevents movement of the outer tube 12 during use of the device 10.

The device 10 of the present invention can be used to collect fluid samples from a subsurface 100, insert fluid into a subsurface 100 or determine the hydrostatic pressure of the groundwater in the subsurface 100 relative to the surface water body 102. The device 10 can be used for subsurfaces 100 located beneath a surface water body 102 or where the subsurface 100 is exposed to air such as on a beach adjacent a surface water body 102. The initial steps for all three (3) uses of the device 10 are essentially the same. Before using the device 10, the inner rod 18 is inserted into the center bore 12D of the outer tube 12. To insert the inner rod 18 into the outer tube 12, the second end 18B of the inner rod 18 is inserted into the open top end 12A of the outer tube 12. The inner rod 18 and outer tube 12 are then positioned such that the inner rod 18 and outer tube 12 are coaxial. The inner rod 18 is then pushed into the center bore 12D of the outer tube 12. To provide leverage, the handle 20 of the inner rod 18 can be used to push the inner rod 18 into the outer tube 12. The handle 20 of the inner rod 18 and the handle 16 of the outer tube 12 can also be squeezed together to help move the inner rod 18 into the outer tube 12. When the inner rod 18 is completely inserted into the center bore 12D such that the handle 20 of the inner rod 18 contacts the open top end 12A of the outer tube 12, the second end 18B of the inner rod 18 extends to the bottom of or beyond the screened zone 12F to completely cover and close the openings 12E in the outer tube 12. In the preferred embodiment, when the handle 20 of the inner rod 18 contacts the open top end 12A of the outer tube 12, the second end 18B of the inner rod 18 is at the bottom of the center bore 12D and the inner rod 18 extends the complete length of the center bore 12D.

Figure 2:
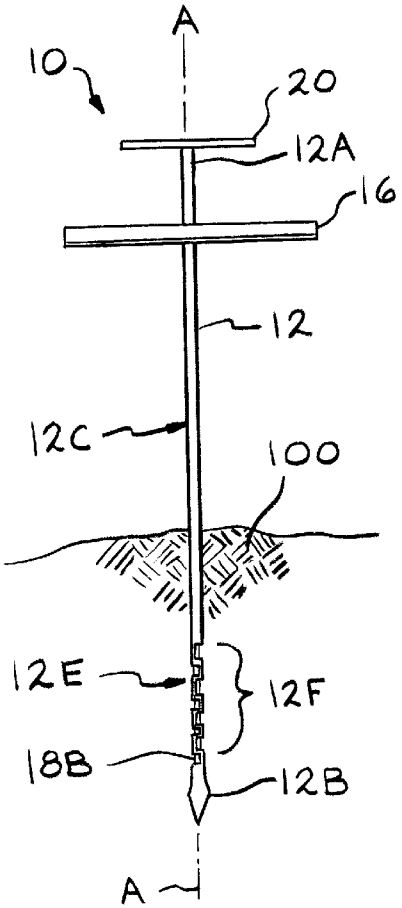
FIG. 2 is a front view of the device 10 inserted into a subsurface 100.

Once the inner rod 18 is completely inserted, the device 10 is inserted into the subsurface 100 until the screened zone 12F is at the desired depth to be sampled (FIG. 2). The outer tube 12 can be provided with indicia (not shown) to determine the depth of the screened zone 12F. The device 10 is inserted into the subsurface 100 by placing the bottom end 12B of the outer tube 12 on the top of the subsurface 100 and pushing downward on the device 10. If a support platform 26 is used, the bottom end 12B of the outer tube 12 is inserted into the opening or the support tube 28 and into the subsurface 100. The angled shape of the bottom end 12B of the outer tube 12 or in the alternate embodiment, the boring tip 14 facilitates insertion of the device 10. The closed bottom end 12B of the outer tube 12 also prevents soil, sediment or fluids from the subsurface 100 from entering the center bore 12D through the bottom end 12B of the outer tube 12. To provide leverage and facilitate insertion of the device 10 into the subsurface 100, the handle 16 of the outer tube 12 can be used to push the device 10 downward into the subsurface 100. Preferably, the device 10 is inserted into the subsurface 100 essentially perpendicular to the subsurface 100. The device 10 is preferably rotated or twisted gently back and forth as the device 10 is inserted to increase the ease of insertion. To keep the inner rod 18 completely inserted in the outer tube 12 during insertion of the device 10, the handles 20 and 16 of the inner rod 18 and the outer tube 12 are preferably squeezed and held together. As the device 10 is inserted, the inner rod 18 provides structural support and prevents the outer tube 12 from bending. The inner rod 18 and the center bore 12D of the outer tube 12 are closely spaced such that the inner rod 18 enhances the rigidity of the outer tube 12 and the device 10 which allows the device 10 to be inserted into the subsurface 100. The inner rod 18 also provides the structural support necessary to allow the screened zone 12F of the outer tube 12 to maintain the designed slot opening dimensions throughout the deployment of the device 10 and prevent the screened zone 12F from collapsing or breaking. In the preferred embodiment, the inner rod 18 is closely spaced within the outer tube 12 along the entire length of the outer tube 12. However, the inner rod 18 may only be closely spaced in the screened zone 12F where the outer tube 12 is weakened or along the length of the outer tube 12 which is to be inserted into the subsurface 100. The close spacing of the inner rod 18 to the center bore 12D also prevents debris from clogging the openings 12E in the outer tube 12 when the device 10 is inserted into the subsurface 100. The inner rod 18 also completely covers or closes the openings 12E in the screened zone 12F and prevents fluid or other debris such as fine solid material from entering the center bore 12D while the device 10 is being inserted into the subsurface 100. The close fit or small tolerance between the inner rod 18 and the center bore 12D helps to prevent fluid and other debris from entering the center bore 12D.

Once the device 10 is inserted to the desired depth, the inner rod 18 is removed. The inner rod 18 is removed by pulling on the handle 20 of the inner rod 18. Preferably, during removal of the inner rod 18, the handle 16 of the outer tube 12 is held in place to prevent movement of the outer tube 12 as the inner rod 18 is removed. To facilitate removal of the inner rod 18, the inner rod 18 is preferably rotated or twisted slightly, back and forth, about the longitudinal axis AA of the device 10 which loosens the inner rod 18 particularly, adjacent the openings 12E. Once the inner rod 18 is completely removed from the outer tube 12, fluid from the surrounding subsurface 100 enters the center bore 12D of the outer tube 12 through the openings 12E and the device 10 is ready to be used.

To use the device 10 to collect fluid samples, the fluid in the center bore 12D of the outer tube 12 is removed. The fluid can be removed by any well known withdrawing means or suction device such as a syringe 104 or pump 106, such as a peristaltic pump (FIGS. 4 and 5). In an alternative embodiment, the connection tube 22 is connected between the top end 12A of the outer tube 12 and the syringe 104 or pump 106. When a syringe 104 is used to remove the fluid, the receiving end of the syringe 104 can be inserted directly into the open top end 12A of the outer tube 12 or the opposite end of the connection tube 22 (FIG. 4). The plunger of the syringe 104 is then drawn back which draws the fluid from the center bore 12D into the container of the syringe 104. The fluid in the container can then be used as a sample. The syringe 104 is preferably similar to a standard syringe. Preferably, the syringe 104 is constructed of a material which will not contaminate the fluid sample. The syringe 104 preferably has a polypropylene barrel with a polyethylene plunger. The fluid in the center bore 12D is removed from the top end 12A of the outer tube 12 preferably, at a low-flow sampling rate such as in a range of 50 to 200 ml/min. In the preferred embodiment, prior to removing fluid samples, the fluid from the center bore 12D is removed until the fluid in the center bore 12D does not contain any suspended solids or fine grit material. Alternatively, the fluid in the center bore 12D is removed until the fluid in the center bore 12D is determined to be representative of the fluid in the surrounding subsurface 100.

The device 10 can be used to collect fluid samples at multiple depths in one (1) hole. The fluid samples are collected from the deepest depth to the shallowest depth. To collect multiple samples, the device 10 is inserted to the depth of the deepest sample area. The sample is collected from that depth. The device 10 is then pulled upward partially out of the hole so that the screened zone 12F is at the second deepest area from which a sample is collected. The sample is then collected and the device 10 is moved to the third deepest area and so on until all the samples are collected.

If the top end 12A of the outer tube 12 is above the static level of the surface water body 102, a valve or clamp (not shown) can be provided on the connection tube 22 extending between the open top 12A of the outer tube 12 and the suction device 104 or 106. The valve prevents the water in the connection tube 22 from moving to the static water level when the suction device 104 or 106 is removed. If the water level in the connection tube 22 drops, air is allowed into the connection tube 22 and the inner bore 18 of the outer tube 12 which can make obtaining representative, uncompromised samples more difficult due to the presence of gases in the sample. Tests which can be performed on the extracted fluids include, but are not limited to: analysis of soil gas samples, groundwater pH measurement, analysis of soil gas or groundwater for volatile chemicals, electrical conductivity, redox potential, temperature, dissolved oxygen, dissolved minerals, dissolved metals, etc.

The device 10 can also be used to inject fluids into the subsurface 100. The device 10 is inserted into the subsurface 100 similarly to when used for sampling and the inner rod 18 is removed. The fluid to be delivered into the subsurface 100 is then injected into the center bore 12D of the outer tube 12. The fluid moves from the center bore 12D through the openings 12E and into the subsurface 100. Any well known device such as a syringe 104 or a pump 106 can be used to move the fluids into the center bore 12D. The connection tube 22 can be attached to the top end 12A of the outer tube 12 to allow for easier insertion of the fluid into the center bore 12D. The device 10 can be used to inject nutrients or dyes into the subsurface 100 for biological or geochemical testing or tracing groundwater paths.

One (1) other use of the device 10 is to measure the static water level (potential) at the location of the screened zone 12F. To use the device 10 to check the groundwater static pressure, the device 10 is inserted into the subsurface 100 beneath a surface water body 102 and the inner rod 18 is removed. A measuring tube 24 is attached to the top end 12A of the outer tube 12 (FIG. 6). A suction-type pump 106 or syringe 104 is attached to the open, top end 24A of the measuring tube 24 and groundwater is drawn from the subsurface 100 through the center bore 12D and the measuring tube 24 to expel any air from the measuring tube 24 and to insure a continuous connection of water from the groundwater system through the outer tube 12 and the measuring tube 24. The measuring tube 24 is then positioned based on the water level of the surface water body 102. Preferably, the measuring tube 24 is positioned such that the second end 24B of the measuring tube 24 is above the water level of the surface water body 102 and a middle portion 24C of the measuring tube 24 is positioned below the water level of the surface water body 102 (FIG. 6). The suction type pump 106 or syringe 104 is then disconnected from the measuring tube 24 and the groundwater is allowed to reach a static level within the center bore 24D of the measuring tube 24. This level is the static water level of the aquifer at the screened zone 12F (FIG. 6). If the water level in the measuring tube 24 is at a higher elevation than the surface or water level of the surface water body 102, then the groundwater has a positive hydrostatic head or a positive pressure and there is the potential for groundwater to enter the surface water body 102. If the water level $L_2$in the measuring tube 24 is at a lower elevation than the surface or water level of the surface water body 102, then the groundwater has a negative hydrostatic head or a negative pressure and there is a potential for the surface water to leave the surface water body 102 and enter the groundwater realm.

The device 10 makes possible the collection of discrete fluid samples from any depth less than the physical length of the device 10. The dimensions of the device 10 are discretionary and can be engineered to meet site specific sampling requirements. However, the device 10 performs best and causes minimal disturbance to the subsurface 100 when the outer diameter of the outer tube 12 is only as large as necessary to allow the device 10 to function properly. The smaller size of the device 10 facilitates low-force, rapid insertion into subsurface 100 (soil or sediment) which leads to rapid sample collection for site characterization.

It is intended that the foregoing description be only illustrative of the present invention and that the present invention be limited only by the hereinafter appended claims.

I claim:

1. A device for use in moving a fluid into or out of a subsurface which comprises:

(a) an outer tube having an open first end and a closed second end with a center bore extending therebetween defining a longitudinal axis of the device and having at least one opening adjacent the second end; and (b) an inner rod having a first end and a second end with an outer surface having no openings with a handle mounted adjacent the first end and configured to be telescopingly inserted into the center bore of the outer tube, wherein in use, the inner rod is inserted into the center bore of the outer tube such that the inner rod closes the opening at the second end of the outer tube and the device is inserted into the subsurface with the second end of the outer tube entering the subsurface first, wherein when the device is at a desired depth in the subsurface, the inner rod is completely removed from the outer tube which opens the opening which allows fluid to be inserted or removed from the subsurface through the opening.

2. The device of claim 1 wherein a handle is provided adjacent a first end of the outer tube to facilitate insertion of the device into the subsurface.

3. The device of claim 1 wherein the second end of the outer tube is angled and has a point to facilitate insertion of the device into the subsurface.

4. The device of claim 1 wherein the opening in the outer tube is a slot which extends partially around a circumference of the outer tube perpendicular to the longitudinal axis of the device.

5. The device of claim 1 wherein the inner rod has a length such that when the inner rod is fully inserted into the outer tube with the handle adjacent the open first end of the outer tube, the inner rod extends beyond the opening toward the second end of the outer tube.

6. The device of claim 1 wherein there are a plurality of openings in the outer tube.

7. The device of claim 1 wherein at least a portion of the inner rod is closely spaced within the outer tube such that the inner rod provides rigid support for the outer tube during insertion of the device into the subsurface and prevents debris and fluid from the subsurface from entering the openings during insertion of the device into the subsurface.

8. The device of claim 1 wherein the subsurface is covered by a surface water body, wherein a measuring tube is provided having a first end and a second end with an inner bore extending therebetween and wherein the first end of the measuring tube is configured to connect to the open first end of the outer tube to collect water from the outer tube to determine the hydrostatic pressure of groundwater in the subsurface.

9. The device of claim 1 wherein a support platform having an opening is positioned on the subsurface, and wherein the outer tube is inserted through the opening into the subsurface and wherein the platform provides support for the outer tube during use of the device.

10. The device of claim 9 wherein the platform has a support tube which guides the outer tube into the subsurface and prevents movement of the outer tube during use of the device.

11. A method for delivering a fluid to a subsurface which comprises the steps of:

(a) providing a device having an outer tube with opposed ends with a center bore extending between the ends and with at least one opening adjacent the second end extending into the center bore and having an inner rod with opposed ends with a handle at one end and configured to be telescopingly inserted into the center bore of the outer tube;

(b) inserting the inner rod into the center bore of the outer tube such that the inner rod closes the opening;

(c) inserting the device into the subsurface to a desired depth;

(d) completely removing the inner rod from the center bore of the outer tube;

(e) providing a means for inserting the fluid into the center bore of the device; and (f) inserting the fluid into the center bore of the device such that the fluid exits the device through the opening and enters the subsurface adjacent the opening.

12. The method of claim 11 wherein the fluid is a tracer mixture.

13. A sampling device for use in collecting a fluid sample from a subsurface, which comprises:

(a) an outer tube having an open first end and a closed second end with a center bore extending therebetween defining a longitudinal axis of the device and having at least one opening adjacent the second end; and (b) an inner rod having a first end and a second end with an outer surface having no openings and with a handle mounted adjacent the first end and configured to be telescopingly inserted into the center bore of the outer tube wherein to collect the fluid sample from the subsurface, the inner rod is inserted into the center bore of the outer tube such that the inner rod closes the opening at the second end of the outer tube and the device is inserted into the subsurface with the second end of the outer tube entering the subsurface first, wherein when the device is at a desired depth in the subsurface, the inner rod is removed from the outer tube which opens the opening and allows fluid to move into the center bore of the outer tube and the fluid sample is collected from the center bore through the open first end of the outer tube.

14. The device of claim 13 wherein a handle is provided adjacent a first end of the outer tube to facilitate insertion of the device into the subsurface.

15. The device of claim 13 wherein the second end of the outer tube is angled and has a point to facilitate insertion of the device into the subsurface.

16. The device of claim 13 wherein the opening in the outer tube is a slot which extends partially around a circumference of the outer tube perpendicular to the longitudinal axis of the device.

17. The device of claim 16 wherein the slot extends approximately ¾ of the circumference of the outer tube.

18. The device of claim 13 wherein the inner rod has a length such that when the inner rod is fully inserted into the outer tube with the handle adjacent the open first end of the outer tube, the inner rod extends beyond the opening toward the second end of the outer tube.

19. The device of claim 13 wherein there are a plurality of openings in the outer tube.

20. The device of claim 13 wherein a boring tip is attached to the second end of the outer tube to facilitate insertion of the device into the subsurface.

21. The device of claim 13 wherein an outer diameter of the inner rod is only slightly less than a diameter of the center bore of the outer tube such that the inner rod is closely spaced within the outer tube and provide rigid support for the outer tube during insertion of the tube into the subsurface.

22. A method for removing a fluid sample from a subsurface which comprises the steps of:

(a) providing a sampling device having an outer tube with opposed ends with a center bore extending between the ends and with at least one opening adjacent the second end extending into the center bore and having an inner rod with opposed ends with a handle at one end and configured to be telescopingly inserted into the center bore of the outer tube;

(b) inserting the inner rod into the center bore of the outer tube such that the inner rod closes the opening;

(c) inserting the sampling device into the subsurface to a desired depth;

(d) completely removing the inner rod from the center bore of the outer tube such that fluid in the subsurface adjacent the opening is able to move into the center bore of the outer tube;

(e) providing a means for removing the fluid sample from the fluid in the center bore of the outer tube; and (f) removing the fluid sample from the fluid in the center bore of the outer tube.

23. The method of claim 22 wherein the outer tube of the sampling device has an open first end and a closed second end and wherein the fluid sample is removed from the open first end of the outer tube.

24. The method of claim 23 wherein the means for removing the fluid sample is a syringe having a container with a receiving tube and a plunger for drawing fluid into the container through the receiving tube and wherein in step (f) to remove the fluid sample, the receiving tube of the syringe is placed in fluid communication with the fluid in the center bore of the outer tube through the open first end of the outer tube and the plunger is moved to draw the fluid sample from the center bore into the container.

25. The method of claim 23 wherein the means for removing the fluid sample is a pump and wherein in step (f) to remove the fluid sample, the pump is connected to the open first end of the outer tube and activated to draw the fluid sample from the center bore through the open first end of the outer tube.

26. The method of claim 23 wherein prior to step (f), a connection tube having opposed ends is connected at one end to the open first end of the outer tube and at the other end to the means for removing the fluid sample.

27. The method of claim 22 wherein prior to step (f), the fluid in the center bore of the outer tube is removed until the fluid is free of fine material.

28. The method of claim 22 wherein prior to step (f), fluid is removed from the center bore until the fluid in the center bore is representative of the fluid in the subsurface.

29. The method of claim 22 wherein to remove the inner rod, the inner rod is rotated about a longitudinal axis of the device to loosen the inner rod in the center bore of the outer tube to facilitate removal of the inner rod.

30. A device for determining hydrostatic pressure of groundwater in a subsurface under a surface water body, which comprises:

(a) an outer tube having an open first end and a closed second end with a center bore extending therebetween defining a longitudinal axis of the device and having at least one opening adjacent the second end;

(b) an inner rod having a first end and a second end with a handle mounted adjacent the first end and configured to be telescopingly inserted into the center bore of the outer tube; and (c) a measuring tube having a first end and a second end and configured to be connected at the first end to the first end of the outer tube and having a length such that when the second end of the measuring tube is spaced apart from the surface water body in a direction opposite the second end of the outer tube, a portion of the measuring tube between the ends is positioned in the surface water body, wherein to determine the hydrostatic pressure of the groundwater in the subsurface, the inner rod is inserted into the center bore of the outer tube such that the inner rod closes the opening at the second end of the outer tube and the device is inserted into the subsurface with the second end of the outer tube entering the subsurface first, wherein when the device is at a desired depth in the subsurface, the inner rod from the outer tube is removed which opens the opening and allows fluid to move into the center bore of the outer tube and the measuring tube is connected to the first end of the outer tube and positioned such that the second end of the measuring tube is spaced apart from the surface water body in a direction opposite the second end of the outer tube and the portion of the tube between the ends is positioned in the surface water body wherein the hydrostatic pressure is determined by a water level in the measuring tube.

31. The device of claim 30 wherein the measuring tube is constructed of a flexible material.

32. The device of claim 30 wherein at least a portion of the measuring tube is transparent.

33. A method for measuring hydrostatic pressure of groundwater in a subsurface under a surface water body, which comprises the steps of:

(a) providing a device having an outer tube with opposed ends with a center bore extending between the ends and with at least one opening adjacent the second end extending into the center bore and having an inner rod with opposed ends with a handle at one end and configured to be telescopingly inserted into the center bore of the outer tube and a measuring tube having a first end and second end and configured to be connected at the first end to one end of the outer tube;

(b) inserting the inner rod into the center bore of the outer tube such that the inner rod closes the opening adjacent the second end of the tube;

(c) inserting the device into the subsurface to a desired depth;

(d) removing the inner rod from the outer tube of the device such that the opening is opened;

(e) connecting the first end of the measuring tube to the end of the outer tube;

(f) positioning the measuring tube such that the second end of the tube is spaced apart from the surface water body and a portion of the measuring tube between the ends is positioned in the surface water body;

(g) providing a means for drawing the groundwater from the subsurface in the center bore of the outer tube into the measuring tube;

(h) connecting the means for drawing the groundwater to the second end of the measuring tube and drawing groundwater from the center bore to the second end of the measuring tube;

(i) disconnecting the means for drawing the groundwater from the second end of the measuring tube; and (j) measuring a water level in the measuring tube to determine the hydrostatic pressure of the groundwater in the subsurface relative to the surface water body.

34. The method of claim 33 wherein the groundwater is drawn into the measuring tube until all gases have been removed from the center bore and measuring tube.

* * * * *